US006076587A

United States Patent [19]

Pastor

[11] Patent Number: 6,076,587

[45] Date of Patent: Jun. 20, 2000

[54] TILTING MECHANISM FOR A VENETIAN BLIND

[75] Inventor: Vincente Miguel Segui Pastor, Valencia, Spain

[73] Assignee: Holis Metal Industries Ltd., Israel

[21] Appl. No.: 09/095,656

[22] Filed: Jun. 11, 1998

[30] Foreign Application Priority Data

Jun. 24, 1997 [ES] Spain ..... 9701393

[51] Int. Cl.[7] ..... E06B 3/48

[52] U.S. Cl. ..... 160/115; 160/168 N; 160/177 V; 160/178.1 V

[58] Field of Search ..... 160/115, 113, 160/114, 176.1 R, 167 R, 174 R, 176.1 V, 177 R, 178.1 R, 168.1 V, 173 V; 192/48.91, 69.63

[56] References Cited

U.S. PATENT DOCUMENTS

| | | | |
|---|---|---|---|
| 558,372 | 4/1896 | Errington | 160/115 |
| 4,200,135 | 4/1980 | Hennequin | 160/168 R |
| 4,267,875 | 5/1981 | Koks | 160/176 R |
| 4,316,493 | 2/1982 | Arena | 160/168 R |
| 4,456,049 | 6/1984 | Vecchiarelli | 160/176 R |
| 4,621,672 | 11/1986 | Hsu | 160/115 |
| 4,799,527 | 1/1989 | Villoch et al. | 160/168.1 |
| 5,119,868 | 6/1992 | Werner | 160/115 |
| 5,266,068 | 11/1993 | Benthin | 160/168.1 X |
| 5,402,840 | 4/1995 | Jortner et al. | 160/115 |
| 5,413,162 | 5/1995 | Ciriaci | 160/177 |
| 5,485,874 | 1/1996 | Whitmore | 160/115 |
| 5,501,116 | 3/1996 | Weng | 74/89.14 |
| 5,575,323 | 11/1996 | Smuckler | 160/177 |
| 5,845,695 | 12/1998 | Cadorette et al. | 160/173 V |

FOREIGN PATENT DOCUMENTS 0 620 355 A1 10/1994 European Pat. Off. .

*Primary Examiner*—Daniel P. Stodola
*Assistant Examiner*—Bruce A. Lev
*Attorney, Agent, or Firm*—Venable; Robert Kinberg

[57] ABSTRACT

A venetian blind comprising: a top rail; a bottom rail; a first group of slats; at least two first ladders extending between the top and bottom rails and supporting the first group of slats; a second group of slats; at least two second ladders extending between the top rail and the bottom rail and supporting the second group of slats; and a tilt assembly comprising: a tilting rod received within the top rail; a manipulating member for operating the tilting rod; and a reversing mechanism associated with each of the at least one first and second ladders, each reversing mechanism being articulated to the tilting rod and including a first plate and a second plate; each one of said at least two first ladders is connected to a corresponding first plate and each one of said at least two second ladders is connected to a corresponding second plate, said first and second plate being normally biased into rotational engagement with one another, whereby rotation of the tilting rod entails rotation of the first plate and the second plate in the same direction, and further rotation of the tilting rod in the same direction entails disengagement of the first and second plates and rotation of the second plate in an opposite direction.

9 Claims, 5 Drawing Sheets

TILTING MECHANISM FOR A VENETIAN BLIND

FIELD OF THE INVENTION

The present invention is generally in the field of venetian blinds and more specifically it is concerned with a tilting mechanism for controlling the tilt angle of separate groups of slats of a venetian blind.

BACKGROUND OF THE INVENTION

Venetian blinds comprise a plurality of slats horizontally supported by two or more ladders extending between a head or top rail and a foot or bottom rail. A chord is provided for elevating or lowering, the blind to a lowermost or intermediate position.

It is often desirable to tilt the slats in order to darken a room to meet the requirements of individuals present in the room, or to prevent direct sun light from entering the room so as to avoid dazzling and possible damages caused by direct sun light, in particular by the ultra violet rays. Tilting the slats into a suitable angle also prevents viewing into the room through a window. For these and other reasons, there is usually provided a tilting mechanism for tilting the slats about a horizontal axis extending through the slats.

A typical tilting mechanism comprises a worm gear assembly fitted within the top rail and manipulable by a rod extending downwards. However, such tilting mechanisms enables only tilting all the slats of the blind in either one or an other direction. Drawback of this arrangement resides in that it is not possible to tilt some of the blinds in one direction, while other slats are tilted in an other direction so as to allow, on the one hand, sufficient light enter the room, and on the other hand to block direct sun light and to prevent viewing the room from the outside.

Several arrangements have been suggested for tilting a first group of the slats in one direction, while tilting the remaining slats in an other direction, typically in a complimentary angle with respect to the first group of salts.

European Patent Application published as 620355 A1 discloses a tilting assembly comprising an additional operating chord passing over pulleys fitted within the head rail and attached to a desired division of slats, whereby the extent of pulling the additional chord dictates the tilting angle of the division of slats independently from the remaining slats.

The arrangement of the above disclosed Patent Application involves several drawbacks. One problem is that the plurality of chords are likely to tangle with one another. Another drawback is that special arresting are required for fixing the length of the additional chord in order to set the desired tilt angle.

U.S. Pat. No. 5,402,840 discloses a venetian blind in which the slats are divided into upper and lower portions by a divider comprising a spacer and a retainer, which serve to shorten the working length of the tilt adjusting ladders on either the inside or outside of the blind, altering the tilt of the slats of the lower portion so as to be more closed or more open with respect to the slats of the upper portion., depending on the adjustment of the tilt control ladder.

A disadvantage of the device according to that Patent is that a dividing element must be articulated to at least two ladders of the blind and it may frequently happen that the dividing elements are articulated at different heights or unevenly tensioned, thus entailing tilting the blinds not parallel to one another. Displacing each of the at least two divider elements while taking care of correct alignment, is a procedure which might be complex for children or elderly people, and even more so, is impossible for handicaps. It will further be appreciated that displacing the dividing elements is somewhat a hassle.

U.S. Pat. No. 5,119,868, discloses a venetian blind in which the slats of an upper section and the slats of the lower section are separately adjusted using a three-position switch attached to a rotatable and horizontally movable rod. Depending on the position of the switch, rotation of the control rod adjusts the tilt of the slats of either the upper or the lower slat section.

It is an object of the present invention to provide a novel and improved venetian blind in which the above disadvantages are essentially reduced or overcome. It is a further object of the invention to provide an improved tilting device for a Venetian blind.

SUMMARY OF THE INVENTION

According to the present invention there is provided a venetian blind comprising a top rail and a bottom rail, a first group of slats supported by at least two first ladders extending between the top and bottom rails, and a second group of slats supported by at least two second ladders extending between a top rail and a bottom rail; and a tilt assembly comprising a tilting rod received within the top rail and operable by a manipulating member being a rod or cord, a reversing mechanism associated with each of the at least one first and second ladders, each reversing mechanism being articulated to the tilting rod and fitted with a first plate and a second plate; each one of said at least two first ladders is connected to a corresponding first plate and each one of said at least two second ladders is connected to a corresponding second plate; whereby rotation of the tilting rod entails rotation of the first plate and the second plate in the same direction, and whereby further rotation of the tilting rod in the same direction entails rotation of the second plate in an opposite direction.

Inverting the direction of rotation of the second plate occurs in response to over rotation of the tilting rod, whereby the slats of the second group of slats (i,e, the lower group of slats) reach a position in which they can not be further tilted.

According to a preferred embodiment of the invention said reversing mechanism is a planetary gear train comprising a an externally geared tube fixed to or integral with the tilting rod, a drive plate rotatably supporting several satellite sprockets and rotatably fixed to the first plate; said tube being engaged with the satellite sprockets which are in-turn engaged with an internal gearing of the second plate.

Preferably, the tilting rod has a polygonal cross section and the tube has an axial bore with a corresponding cross-section. However, the tube may be rotatably fixed to the tilting rod by other means, as known per se.

According to still a preferred embodiment, the drive plate is spring biased in a direction entailing axial engagement of the first and second plates. Accordingly, the first plate and the second plate are axially biased into rotational engagement with one another.

Preferably, the mating faces of the first and second plates are formed with radial notches which maintain the first plate and the second plate in their rotationally engaged position. However, upon over rotation of the tilting rod the first plate and the second plate disengage from one another, overcoming the biasing force of the biasing spring. The arrangement is such that in a first mode of operation, during rotation of the tilting rod, the first plate and the second plate are rotatably engaged and thus rotate in the same direction. In a second mode of operation, upon further rotation of the tube in the same direction the second plate disengages from the first plate and rotates in an opposite direction.

Typically, the second plate and the biasing spring bare against respective retainers which prevent their axial displacement along the tilting rod.

According to a specific embodiment, the ladders are connected to their respective plates by eyelets. Alternatively, the ladders are connected to pins radially projecting from the plates.

The venetian blinds of the type concerned are typically provided also with a height adjusting assembly usually comprising at least two cords attached to the bottom rail, and retaining means adapted for fixing the slack of the cord, thus adjusting the height of the blind, as known per se.

The present invention further provides a reversing mechanism of the type specified above, for use in conjunction with a venetian blind as described.

BRIEF DESCRIPTION OF THE DRAWINGS

In order to understand the invention and to see how it may be carried out in practice, a preferred embodiment will now be described, by way of a non-limiting example only, with reference to the accompanying drawings, in which.

DETAILED DESCRIPTION OF A PREFERRED EMBODIMENT

Figure 1:
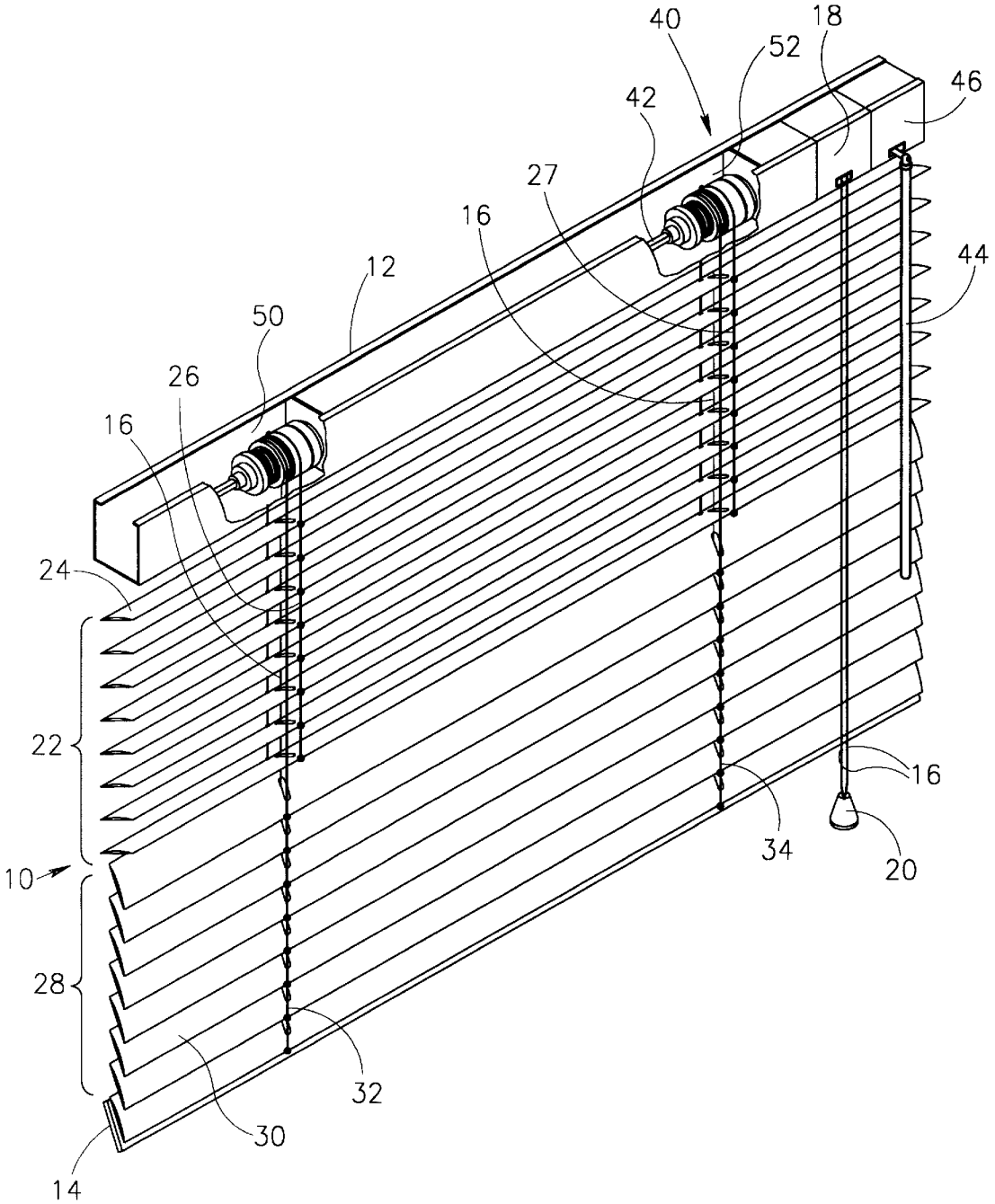
FIG. 1 is a partially sectioned perspective view of a venetian blind according to the present invention.

Attention is first directed to FIG. 1 of the drawings showing a venetian blind generally designated 10 and comprising a top rail 12 adapted for attachment to a ceiling or wall as known per se and a bottom rail 14 suspended from the top rail 12 by two (or more, depending on the size of the blind) elevating cords 16 extending through the top rail 12 and via a retaining mechanism 18 of a known type, with the cords' slack downwardly extending and terminating at a pulling knob 20.

A first group of slats 28 at the lower portion of the blind, comprises a plurality of slats 30, supported by two first ladders 32 and 34, each supporting the slats 30 at their edges (e.g., by the slats resting over the ladders' transverse members or by having edges of the slats attached to vertical members of the ladders). A second group of slats 22, at the upper portion of the blind, comprises a plurality of slats 24, supported by two second ladders 26 and 27 supporting the slats 24 in a manner as explained above.

A tilt assembly generally referred to as 40 comprises a tilting rod 42 having a square cross section, is received within the top rail 12 and is manipulable by a manipulating rod 44 articulated thereto via a worm-gear transmission at 46, the arrangement being such that rotation of manipulating rod 44 entails corresponding rotation of tilting rod 42. It will be noted that rather than a manipulating rod there may be provided a manipulating cord as known per se.

The tilt assembly 40 further comprises a first reversing mechanism 50 associated with ladders 26 and 32, and a second reversing mechanism 52 associated with ladders 27 and 34.

Figure 2:
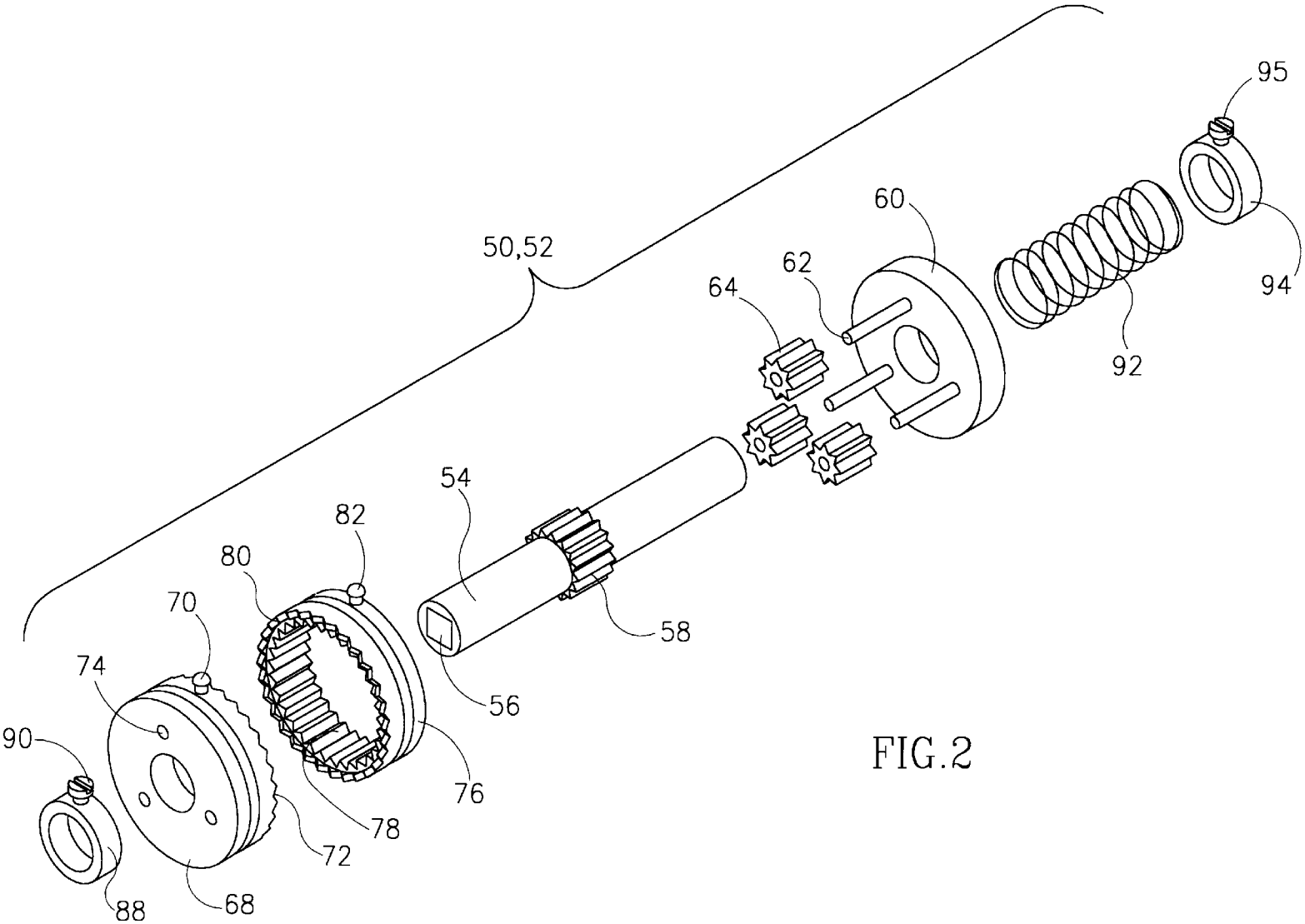
FIG. 2 is an exploded perspective view of the reversing mechanism used with a venetian blind according to the invention.
Figure 5:
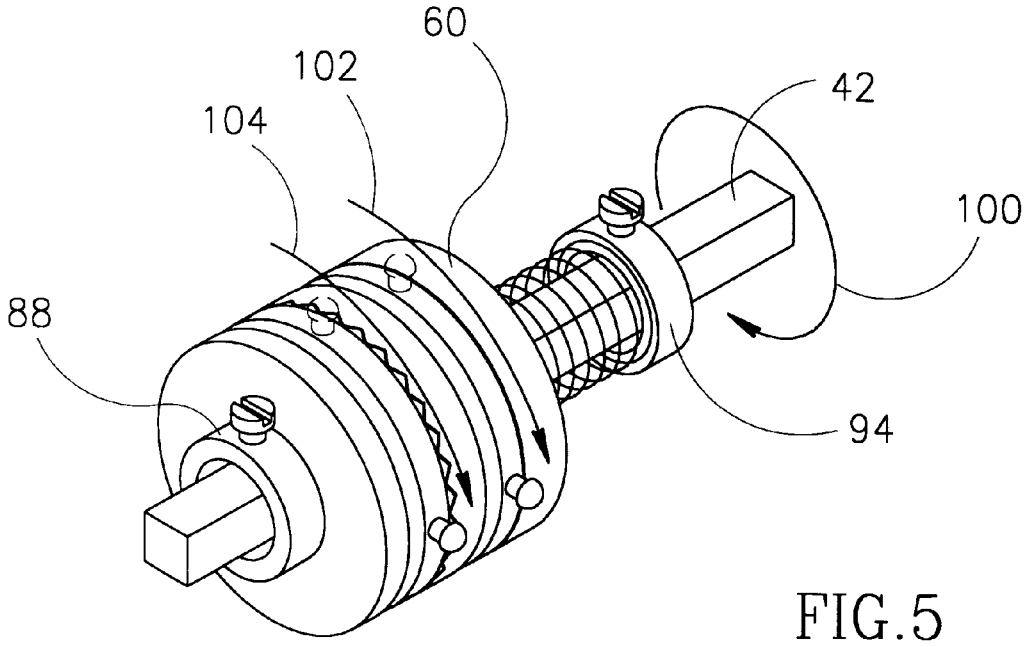
FIG. 5 is a perspective view only of the reversing mechanism in a position in which the first plate and the second plate are rotatably engaged with one another.
Figure 6:
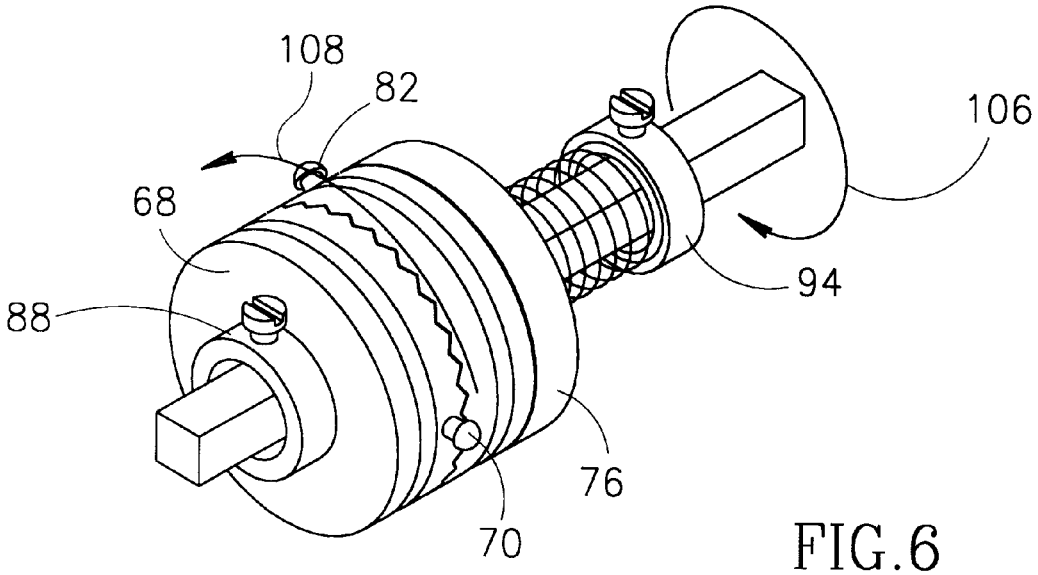
FIG. 6 is a perspective view only of the reversing mechanism in a position in which the first plate and the second plate are rotatably disengaged from one another.

Further attention is now directed to FIG. 2, as well as to FIGS. 5 and 6, illustrating the construction of the reversing mechanisms 50 and 52. A tube member 54 has an axial bore 56 with a cross section corresponding with that of tilting rod 42 and is formed with an externally geared rim 58. A drive plate 60 is rotatably mounted over tube and is fitted with three axially extending shafts 62, each rotatably holding a satellite sprocket 64, whereby the three satellite sprockets are engaged with the geared rim 58 of tube member 54.

A first plate 68 is rotatably mounted over the tube member 54, said first plate has on its periphery a radially projecting stud 70 and a plurality of radial notches 72, on a face thereof facing the drive plate 60. The first plate 68 comprises three bores 74 for fit receiving of the shafts 62 axially projecting from the drive plate 60. A second plate 76 is formed with an internal gearing 78 adapted for engagement with the gearing of the satellite sprockets 64. A face of the second plate facing the first plate comprises a plurality of radial notches 80 adapted for engagement with notches 72 of the first plate, as will hereinafter be explained. The second plate 76 has on its periphery a radially projecting stud 82.

After mounting the first plate 68 over the tube member 54, a retaining ring 88 is secured to the tube member by means of screw 90. A coiled spring 92 is mounted between the drive plate 60 and a second retaining ring 94 secured by screw 95, thus biasing the drive plate towards the second plate 76, and the later into engagement with the first plate 68, thus compacting the reverse mechanism, as seen in FIG. 4.

As seen in FIG. 1 (and also partly in FIGS. 3 and 4), ladder 32 is attached to stud 70 of the first plate 68 of reversing mechanism 50 and ladder 26 is attached to stud 82 of the second plate 76 of the same reversing mechanism. Similarly, ladder 34 is attached to stud 70 of the first plate 68 of reversing mechanism 52 and ladder 27 is attached to stud 82 of the second plate 76 of the same reversing mechanism. It will thus be appreciated that rotation of the first and second plates will cause winding or dispensing of the ladder cords respective to the direction of rotation of the plates.

Figure 3:
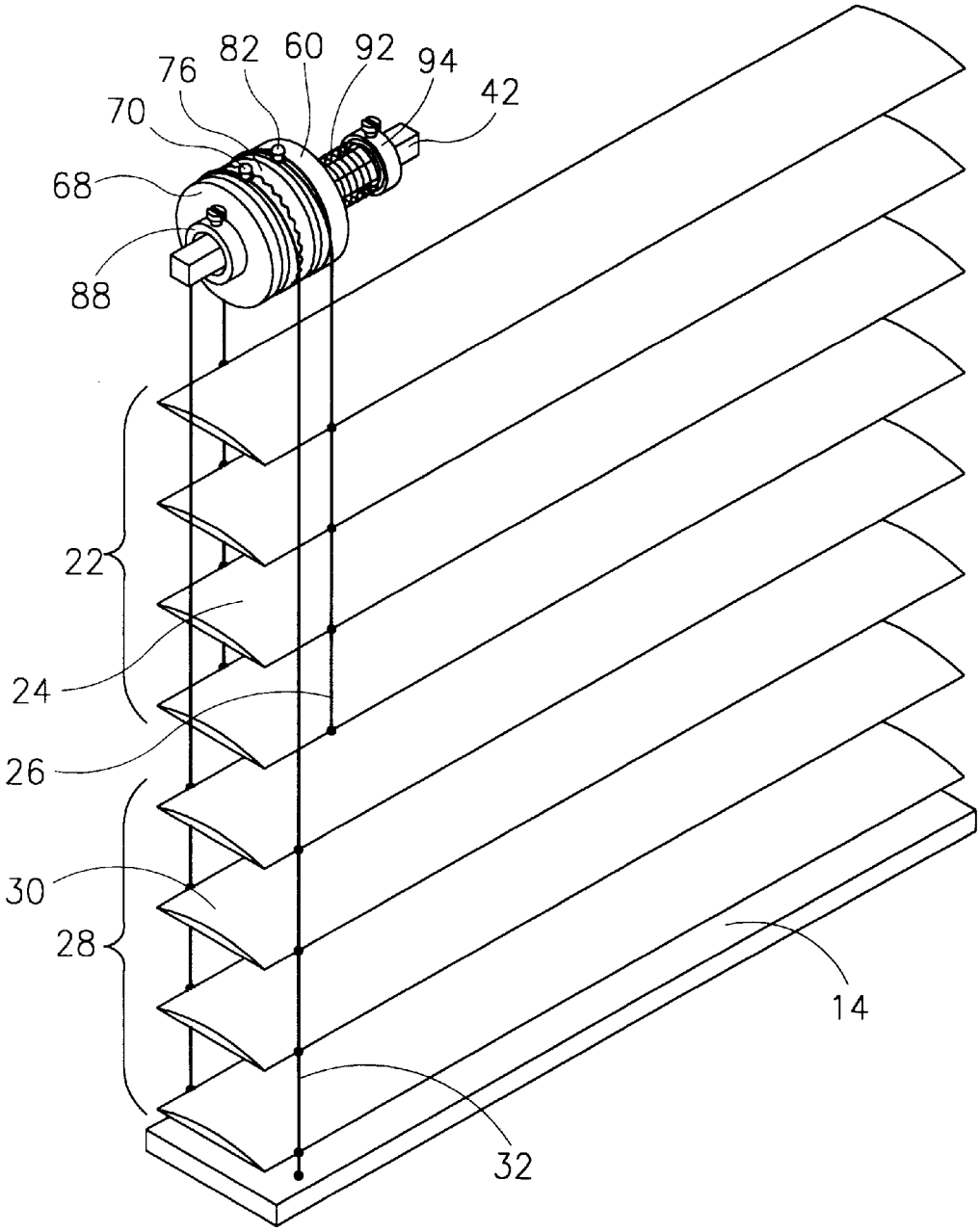
FIG. 3 is a perspective view of the blind with some components hidden, the blind in a first position in which all the slats of the blind are uniformly tilted.

The arrangement is such that in a first mode of operation, as illustrated in FIGS. 3 and 5, the first plate 68 and the second plate 76 are rotatably engaged with one another at their mating notched faces, whereby rotating the tilting rod 42, e,g, in direction of arrow 100 in FIG. 5, entails rotation of the first and second plates in the same direction, as illustrated by arrows by arrows 102 and 104, correspondingly. In this mode of operation, the slats 30 of the first group of slats 28 and the slats 24 of the second group of slats 22, are uniformly rotated, depending on the direction of rotating the manipulating rod 44.

Figure 4:
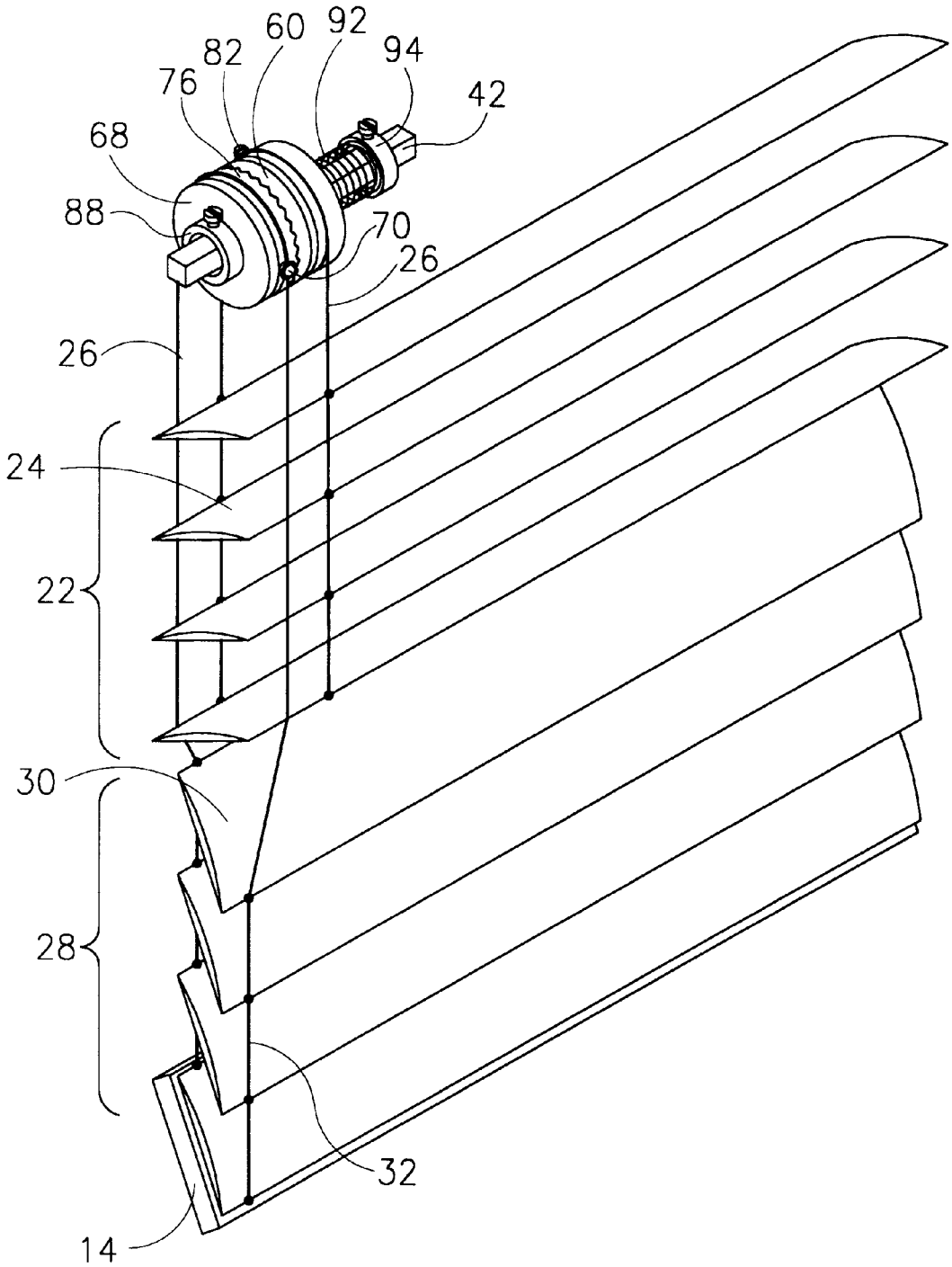
FIG. 4 is a perspective view of the blind with some components hidden, the blind shown in another position in which the first group of slats is tilted at a different angle than that of the second group of slats.

In a second mode of operation, illustrated in FIGS. 4 and 6, when the tilting rod 42 is over-rotated in the same direction (i,e, in direction of arrow 106 in FIG. 6), the slats 30 of the first slat group 28 reach a position in which they can not be further tilted. In this position the satellite sprockets 64 are forced to rotate in the opposite direction entailing the second plate 76 to reverse its direction of rotation whereby the second plate 76 disengages from the first plate 68, overcoming the biasing effect of the coiled spring 92, allowing the plates to independently rotate in opposed directions, whereby the second plate 76 now rotates in direction of arrow 108. In this position the second group of slats 22 now rotates in a reversed direction, whereby the first and second slat groups acquire opposite tilting angles as seen in FIGS. 1 and 4.

However, upon ceasing the rotation of the tilting rod 42, the first and second plates re-engage into the position seen in FIGS. 3 and 5 so the slats of the first and second groups maintain their different tilted angles.

It should be understood that it is preferred to provide a reversing mechanism for each couple of first and second ladders in order to ensure smooth and equal tilting of the slats. However, for essentially small blinds a single reversing mechanism may be used, although a minimum of two reversing mechanisms is preferable.

I claim:

1. A venetian blind comprising:

a top rail;

a bottom rail;

a first group of slats;

at least two first ladders extending between the top and bottom rails and supporting the first group of slats;

a second group of slats;

at least two second ladders extending between the top rail and the bottom rail and supporting the second group of slats; and a tilt assembly comprising:

a tilting rod received within the top rail;

a manipulating member for operating the tilting rod; and a reversing mechanism associated with each of the at least one first and second ladders, each reversing mechanism being articulated to the tilting rod and including a first plate and a second plate and a means for biasing said first and second plate into axial engagement with one another whereby rotation of the tilting rod entails rotation of the first plate and the second plate in the same direction, and further rotation of the tilting rod in the same direction entails disengagement of the first and second plates, and rotation of the second plate in an opposite direction, and wherein each one of said at least two first ladders is connected to a corresponding first plate and each one of said at least two second ladders is connected to a corresponding second plate whereby rotation of the tilting rod entails rotation of the first plate and the second plate in the same direction, and whereby further rotation of the tilting rod in the same direction entails rotation of the second plate in an opposite direction.

2. A venetian blind according to claim 1, wherein said reversing mechanism further includes a planetary gear train comprising:

a drive plate fixed to the first plate;

a plurality of satellite sprockets rotatably supported by the drive plate; and an externally geared tube one of fixed to and integral with the tilting rod, said tube being engaged with the satellite sprockets which are engaged with an internal gearing of the second plate.

3. A venetian blind according to claim 2, wherein the drive plate is spring biased in a direction entailing axial engagement of the first and second plates.

4. A venetian blind according to claim 3, wherein said first plate and said second plate are axially biased into rotational engagement with one another.

5. A venetian blind according to claim 4, wherein mating faces of the first and second plates are formed with radial notches.

6. A venetian blind according to claim 2, wherein the tilting rod has a polygonal cross section and the tube has an axial bore with a corresponding cross-section.

7. A reversing mechanism according to claim 6, wherein rotation of the tube in one direction entails rotation of the first plate in the same direction and rotation of the second plate in an opposite direction.

8. A venetian blind according to claim 1, wherein the ladders are connected to their respective plates by eyelets.

9. A venetian blind according to claim 1, wherein the means for biasing said first and second plate into axial engagement with one another is a spring.

* * * * *